US006112667A

United States Patent [19]

Bailey et al.

[11] Patent Number: 6,112,667

[45] Date of Patent: Sep. 5, 2000

[54] UNDERWATER MINE PLACEMENT SYSTEM

[75] Inventors: Vernon P. Bailey, North Kingstown; Edward J. Hilliard, Jr., Middletown, both of R.I.

[73] Assignee: The United States of America as represented by the Secretary of the Navy, Washington, D.C.

[21] Appl. No.: 08/990,875

[22] Filed: Dec. 15, 1997

[51] Int. Cl.[7] ..... F42B 22/10; F42B 19/01; B63B 1/00; B63G 8/28

[52] U.S. Cl. ..... 102/411; 114/21.2; 114/238; 114/316; 89/1.809

[58] Field of Search ..... 114/20.1, 20.2, 114/21.1, 21.2, 238, 239, 316; 102/411, 406; 89/1.809, 1.81

[56] References Cited

U.S. PATENT DOCUMENTS

| | | | |
|---|---|---|---|
| 1,296,816 | 3/1919 | Krecioch | 114/316 |
| 1,683,177 | 9/1928 | Fenaux | 114/316 |
| 1,777,416 | 10/1930 | Pratt | 114/316 |
| 3,084,627 | 4/1963 | Holm | 114/20.1 |
| 5,076,170 | 12/1991 | Seiple | 102/411 |
| 5,319,556 | 6/1994 | Bessacini | 114/316 |
| 5,637,826 | 6/1997 | Bessacini et al. | 114/21.1 |
| 5,690,041 | 11/1997 | Hillenbrand et al. | 114/21.2 |

*Primary Examiner*—Charles T. Jordan
*Assistant Examiner*—Theresa M. Wesson
*Attorney, Agent, or Firm*—Michael J. McGowan; Prithvi C. Lall; Michael F. Oglo

[57] ABSTRACT

A mine placement system is provided for determining mine launch parameters based on launcher vehicle position, speed, and direction and on latitude. The system includes an input module for receiving launcher vehicle position, speed, and direction having a settable aim point. The input module is connected to a processor module which continuously calculates the trajectory of the mine as the launch ship maneuvers. The processor module having a vectorizer, a decoder, a time processing unit and gyroprocessing unit drives a launch display having steering cursors and a range display. The steering cursors and range display provide maneuver information to the ship's operator to steer the ship to a launch window which will allow a mine to deploy to the set aim point. In addition to displaying the set aim point, the display also shows the present actual mine placement point based on the launch ships present location and velocity. Whenever a mine is launched, the system records the actual mine placement point. The method of the system includes manually entering the weapon type and the latitude/longitude of a desired aim point. The system then reads the inertial position and heading of the launch ship. By comparing the ship's heading and position to the aim point, the processor drives a launch display showing range and bearing to a launch window. The heading and run time are corrected for Coriolis effect and for a constant water current.

17 Claims, 8 Drawing Sheets

701

703

| | RIGHT TURN | LEFT TURN |
|---|---|---|
| NORTHERN HEMISPHERE (a) IS COUNTER CLOCKWISE | EQUATION 3 AND 5 (a) IS POSITIVE | EQUATION 8 AND 9 (a) IS POSITIVE |
| SOUTHERN HEMISPHERE (a) IS CLOCKWISE | EQUATION 8 AND 9 (a) IS NEGATIVE | EQUATION 3 AND 5 (a) IS NEGATIVE |

FIG. 7

UNDERWATER MINE PLACEMENT SYSTEM

STATEMENT OF GOVERNMENT INTEREST

The invention described herein may be manufactured and used by or for the Government of the United States of America for Governmental purposes without the payment of any royalties thereon or therefor.

BACKGROUND OF THE INVENTION (1) Field of the Invention

The invention is related to the field of underwater mine placement systems and in particular to devices having Coriolis corrections for latitude and launcher velocity.

(2) Description of the Prior Art

Various mine placement devices have been developed over several years. Mine placement accuracy has become increasingly important with respect to precise mine field placement where friendly ships must be able to operate in close proximity to those fields. Various factors effect mine placement accuracy including Coriolis effects from launcher turn radius and velocity during deployment of mines. Mechanisms in use at present attempt to account for the Coriolis effect using only a linear model. This model produces errors in the final mine placement. The present linear model does not account for changes in deployment path caused by Coriolis effects for differing latitude, nor for changes caused by launcher turn radius of the mine as it is deployed. What is needed is a mechanism for determining and setting the launch angle based on the launcher ship's heading and the run time of a small vehicle such as an underwater mobile mine, typically sent from a moving platform to a known, fixed point. While in transit, the mine moves at a fixed velocity which must be corrected for Coriolis effect and for water current velocity.

SUMMARY OF THE INVENTION

Accordingly, it is an object of the invention to provide an underwater mine placement system having a means for correcting mine launch parameters for errors caused by Coriolis effects.

It is another object of the invention to provide an underwater mine placement system having a means of correcting mine launch parameters for errors caused by launcher vehicle speed and turn radius.

It is yet another object of the invention to provide an underwater mine placement system having means for correcting mine launch parameters for errors caused by the water current velocity.

In accordance with these and other objects, a mine placement system is provided for determining mine launch parameters based on launcher vehicle position, speed, and direction and on latitude. The invention includes a device for determining mine launch parameters having an input module for receiving launcher vehicle position, speed, and direction and having a settable aim point. The input module is connected to a processor module which continuously calculates the trajectory of the mine as the launch ship maneuvers. The processor module drives a launch display having steering cursors and a range display. The steering cursors and range display provide maneuver information to the ship's operator to steer the ship to a launch window which will allow the mine to deploy to the set aim point. In addition to displaying the set aim point, the display also shows the present actual mine placement point based on the launch ships present location and velocity. Whenever a mine is launched, the system records the actual mine placement point. The method of the system includes manually entering latitude/longitude of a desired aim point into the placement system memory. Thereafter, the system reads the inertial position of the launch ship and the ship's heading. By comparing the ship's heading and position to the aim point, the processor drives a launch display showing range and bearing to a launch window. Upon reaching the launch window, operator-initiated or automatic launch occurs. The heading and run time are corrected for Coriolis effect and for a constant water current.

BRIEF DESCRIPTION OF THE DRAWINGS

The foregoing objects and other advantages of the present invention will be more fully understood from the following detailed description and reference to the appended drawings wherein:

FIG. 7 is a chart showing when the Coriolis factor, (a), is either positive or negative.

DESCRIPTION OF THE PREFERRED EMBODIMENTS

Figure 1:
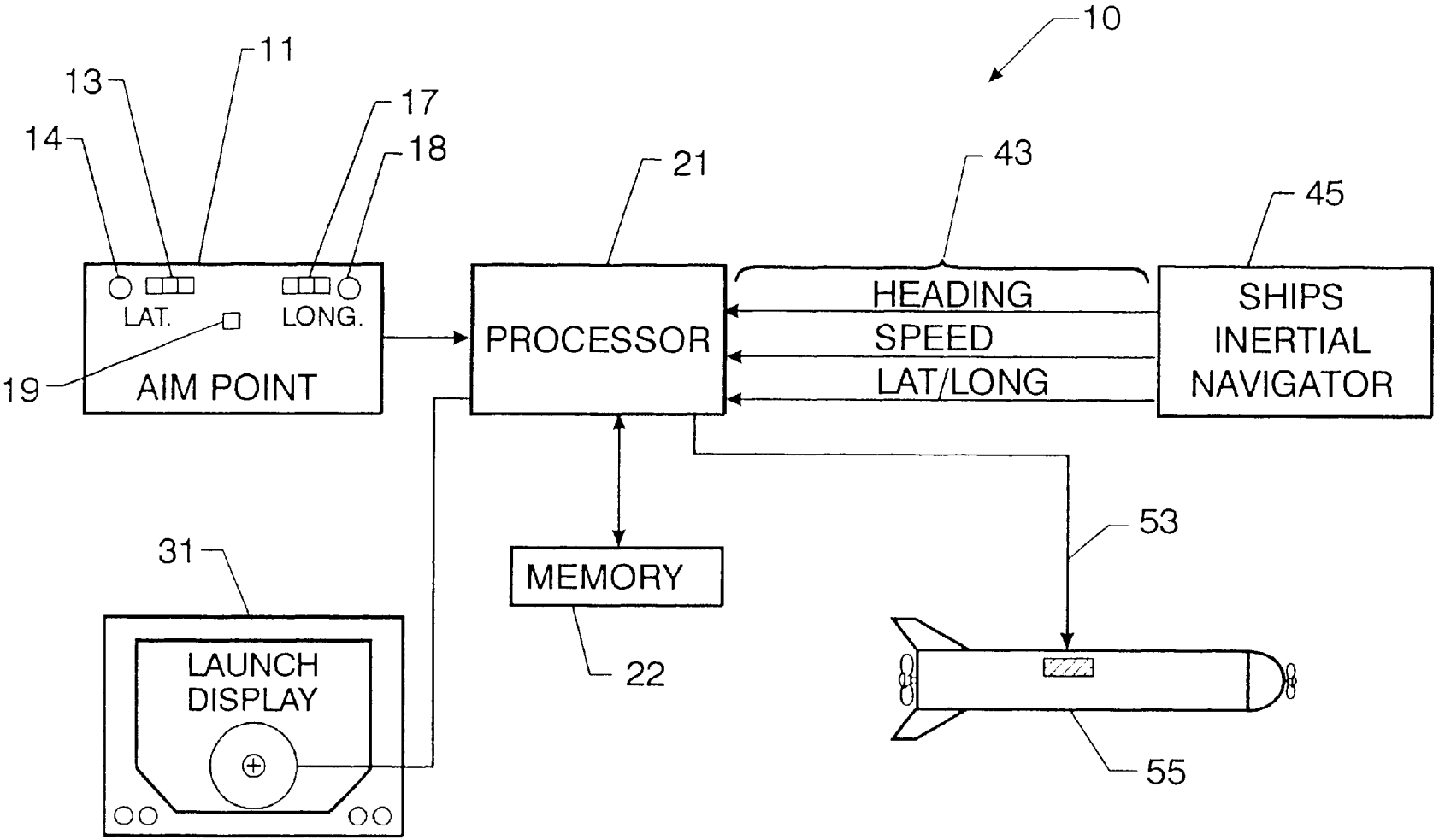
FIG. 1 is a schematic diagram of the underwater mine placement system.

Referring now to FIG. 1, a schematic of the underwater mine placement system, designated generally by the reference numeral 10, is shown with its major components. The system 10 comprises an input module 11, a processor module 21 having an external memory 22, and a launch display 31. Additionally, the mine placement system 10 includes interface connectors 43 for receiving data output from a ship's inertial navigator 45 and the interface connector 53 for transmitting data to an underwater mobile mine 55 (or other underwater weapon). Neither the ship's inertial navigator nor the underwater mobile mine (which are existing hardware) are part of this invention, but are shown only for reference to the interface connectors. The input module 11, an electronic module, has a latitude window 13 with a latitude set control 14 and a longitude window 17 with a longitude set control 18. The mine aim point which has been set in the input module 11 is outputted to the processor module 21 and is further stored in the processor's external memory 22. The processor also simultaneously reads the ship's heading, speed and position from the ship's inertial navigator 45. The processor 21 also receives from the input module 11, weapon type as set in weapon selector 19. Based on these inputs, the processor executes software to provide a launch window.

Figure 2:
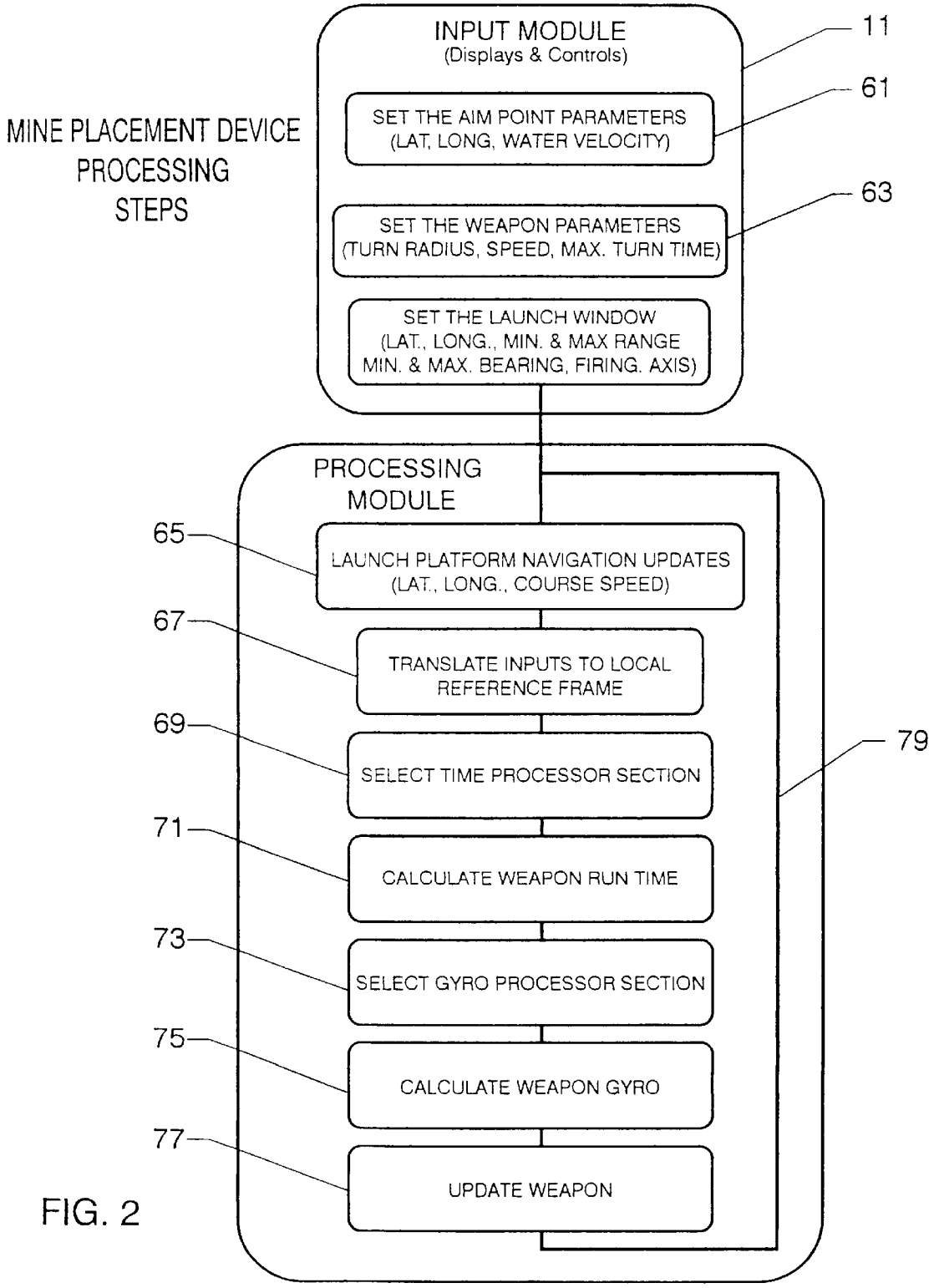
FIG. 2 is a process chart of the method of the underwater mine placement system.

Referring now to FIG. 2, the method of the invention incorporates a sequence of steps to determine certain controlling factors, i.e., the angle ($\omega$) through which the weapon must turn after being launched to place it on the selected mine aim point; and the time of travel from the exit point of the initial turn to the mine aim point. The sequence of steps begin with the manual setting of aim point parameters 61 by the launch officer, i.e. setting latitude and longitude of the mine aim point in input module 11. The system 10 simultaneously sets water current velocity by reading the launch ship's inertial velocity to heading and water speed using the presently available data from this ship's inertial navigator. The launch officer also sets the weapon type which allows the system 10 to set the weapon parameters 63 by reading the stored database information in the external memory 22. The system 10 then automatically sets the launch window parameters and displays steering and launch information on the launch display 31. Thereafter, the system 10 performs the processing sequence to provide updates to the display and underwater weapon by continuously reading the launch ship's navigation data 65, translating the data inputs to a local reference frame 67, selecting time processor section 69, calculating weapon run time 71, selecting gyro processor section 73, calculating the weapon gyro 75 and updating the weapon 77 with launch parameters. The entire sequence is continuously repeated through loop 79 until weapon launch.

Figure 3:
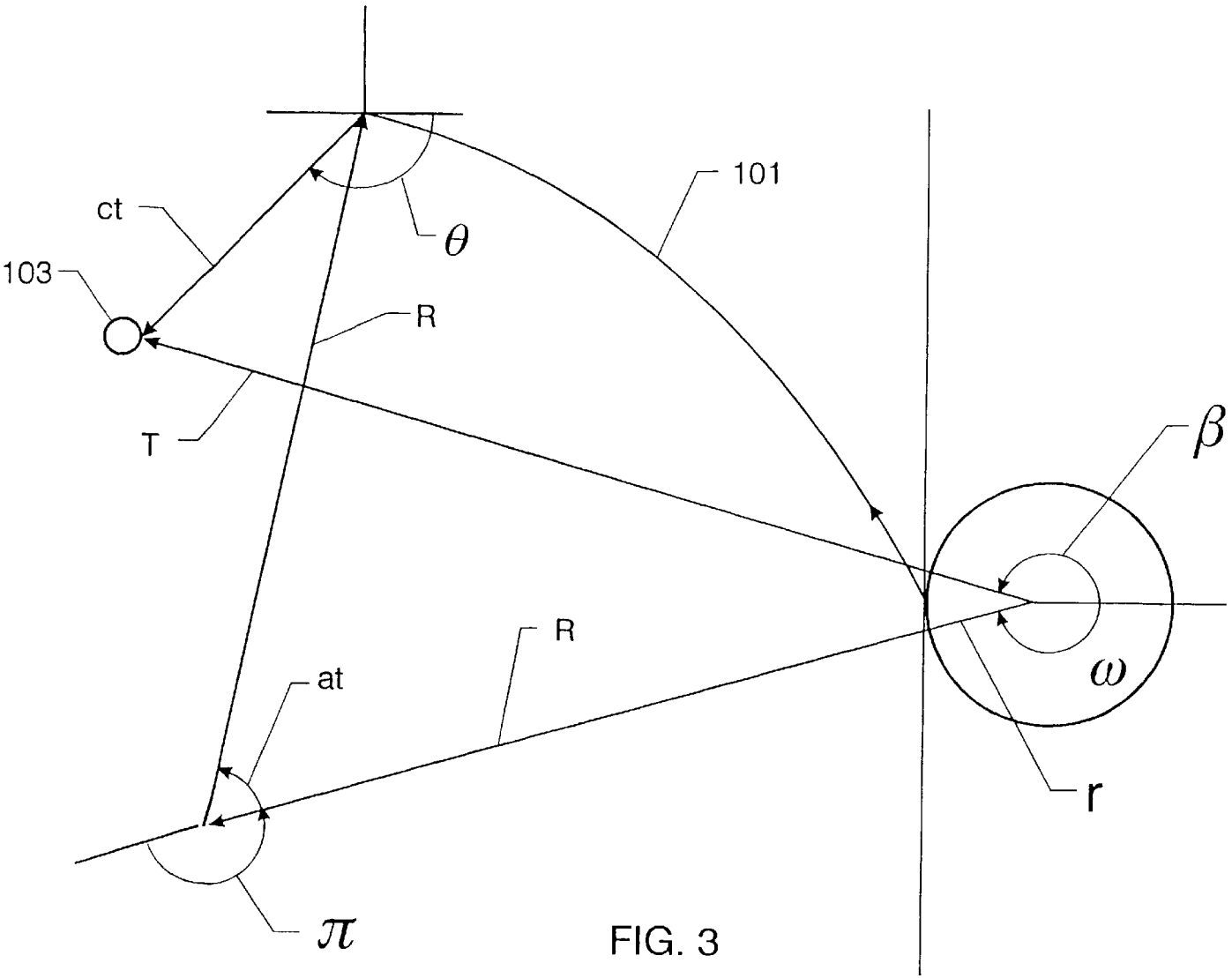
FIG. 3 is a diagram of the Coriolis correction for a right turn in the northern hemisphere.

The mechanics of the process may be more fully understood by reference to FIG. 3 which provides a model of the inertial path 101 of a right turning weapon to a set aim point 103 in the northern hemisphere where the Coriolis force (a) is positive. The values of (ω) and (t) account for the turning of the vehicle caused by the Coriolis force and a steady current flowing with known speed and direction through the operating area. The method of solution requires the addition of vectors around the loop beginning at the center of the turning circle of the weapon. The range, T, and the bearing (β), to the mine aim point are referred to the same center. In FIG. 3 the path 101 is through the turn radius, r, along the Coriolis radius, R, back along the other side of the Coriolis sector, along the current speed vector, (c), in direction (θ), and finally down the aim point vector to close the loop. For clarity, the equation values shown in these diagrams retain their symbol designations instead of numeral designations.

$$re^{j\omega}+Re^{j\omega}+Re^{j(\omega+\pi+\alpha t)}+cte^{j\theta}-Te^{j\beta}=0 \tag{1}$$

This equation is solved for the vector ($e^{J\omega}$) in terms of the run time, (t).

$$e^{j\omega}=\frac{Te^{j\beta}-cte^{j\theta}}{(R+r)-Re^{j\alpha t}} \tag{2}$$

The magnitude squared of a vector is obtained from the product of the vector and its complex conjugate $$e^{j\omega}e^{-j\omega}=e^{j0}=1$$

When carried out for equation 2:

$$\frac{T^2+c^2t^2-2Tct\cos(\beta-\theta)}{(R+r)^2+R^2-2(R+r)R\cos(\alpha t)}=1$$

$$c^2t^2-(2Tc\cos(\beta-\theta))t+2(R+r)R\cos(\alpha t)+T^2-(R+r)^2-R^2=0 \tag{3}$$

The solution of equation 3 gives the run time of the weapon which is used in the next step to calculate the turn angle (ω). The angle of a vector is found by dividing the vector by its complex conjugate. Writing equation 2 in rectangular form:

$$\frac{e^{j\omega}}{e^{-j\omega}}=e^{2j\omega}=\frac{A+jB}{C+jD}C-\frac{jD}{A-jB}=\frac{(AC+BD)+j(BC-AD)}{(AC+BD)-j(BC-AD)}=\frac{x+jy}{x-jy}$$

Taking the natural log of both sides:

$$j2\omega=\ln(x+jy)-\ln(x-jy)= \tag{4}$$

$$\ln\left(\sqrt{x^2+y^2}\right)+j\tan^{-1}\left(\frac{y}{x}\right)-\ln\left(\sqrt{x^2+y^2}\right)-j\tan^{-1}\left(-\frac{y}{x}\right)$$

$$\omega=\tan^{-1}\left(\frac{y}{x}\right)=\tan^{-1}\left(\frac{BC-AD}{AC+BD}\right)$$

The expansions of the numerator and denominator are $$BC-AD=T(R+r)\sin(\beta)-ct(R+r)\sin(\theta)-TR\sin(\beta-at)+Rct\sin(\theta-at) \tag{5A}$$

$$AC+BD=T(R+r)\cos(\beta)-ct(R+r)\cos(\theta)-TR\cos(\beta-at)+Rct\cos(\theta-at) \tag{5B}$$

In equations 5A and 5B inserting the (t) value from equation 3 obtains the angle (ω) through which the weapon must turn from the launching tube axis to its initial course toward the aim point.

Figure 4:
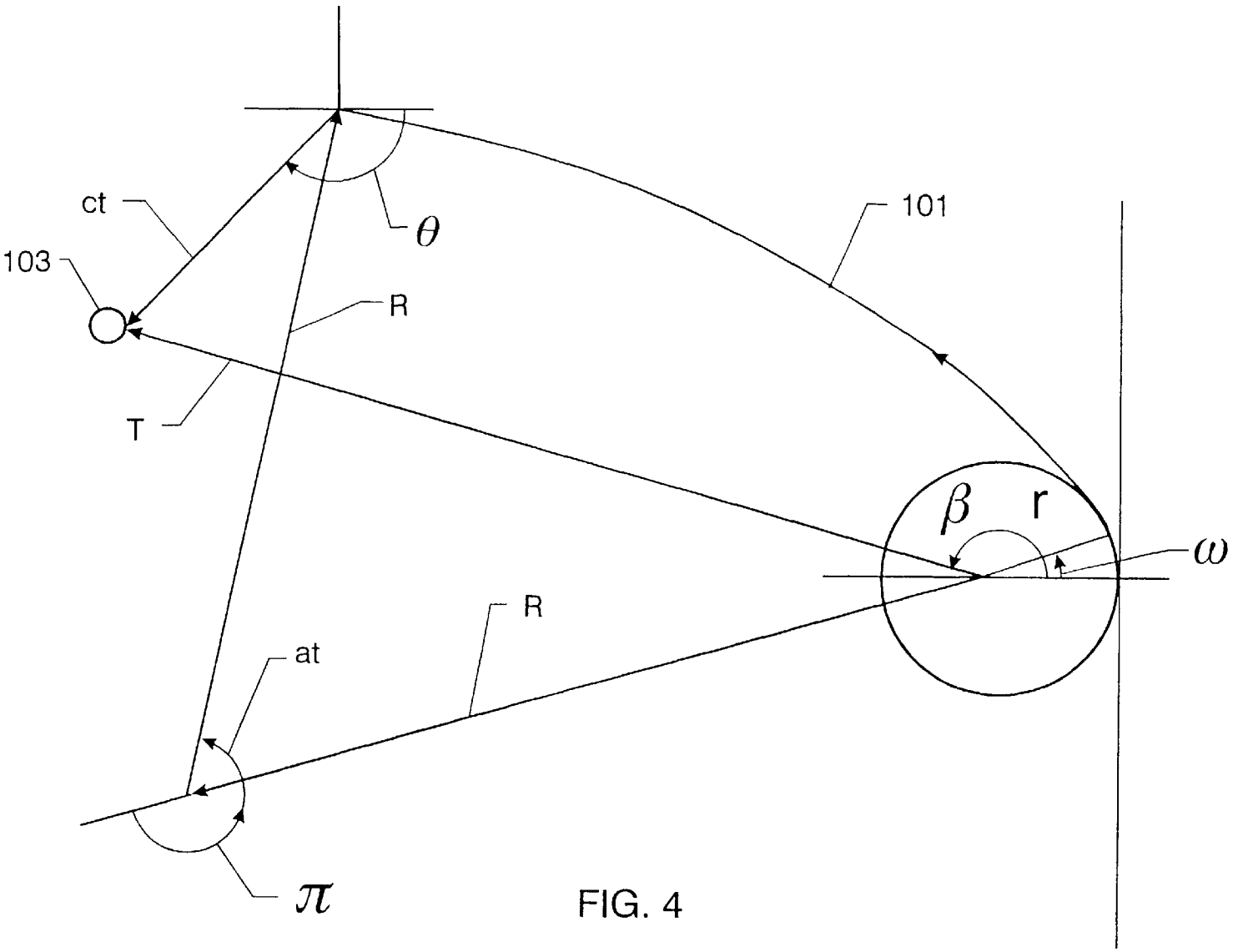
FIG. 4 is a diagram of the Coriolis correction for a left turn in the northern hemisphere.

For comparison, FIG. 4 shows the set aim point 103 with the weapon launched to turn to the left. In this configuration, the turning circle must be inside the Coriolis circle. Equation 6 describes this as:

$$re^{j\omega}+Re^{j(\omega+\pi)}+e^{j(\omega+\pi+\pi30\ at)}+cte^{j\theta}-Te^{e\beta}=0 \tag{6}$$

Which gives $$e^{j\omega}=\frac{Te^{j\beta}-cte^{j\theta}}{-(R-r)+Re^{j\alpha t}} \tag{7}$$

$$c^2t^2-(2Tc\cos(\beta-\theta))t+2(R-r)R\cos(at)+T^2-(R-r)^2-R^2=0 \tag{8}$$

The only difference between equation 3 and equation 8 is in the terms containing (R−r) instead of (R+r). The procedure for finding (ω) is repeated starting with equation 7. The results are:

$$BC-AD=-T(R-r)\sin(\beta)+ct(R-r)\sin(\theta)+TR\sin(\beta-at)-Rct\sin(\theta-at) \tag{9A}$$

$$AC+BD=-T(R-r)\cos(\beta)+ct(R-r)\cos(\theta)+TR\cos(\beta-at)-Rct\cos(\theta-at) \tag{9B}$$

The differences here as compared to equation 5 are the substitution of (R−r) for (R+r) and all of the terms are the negatives of those in equation 5. Since these terms are used in a quotient of an arctangent function, the signs are retained so that the quadrant location will be correct.

Figure 5:
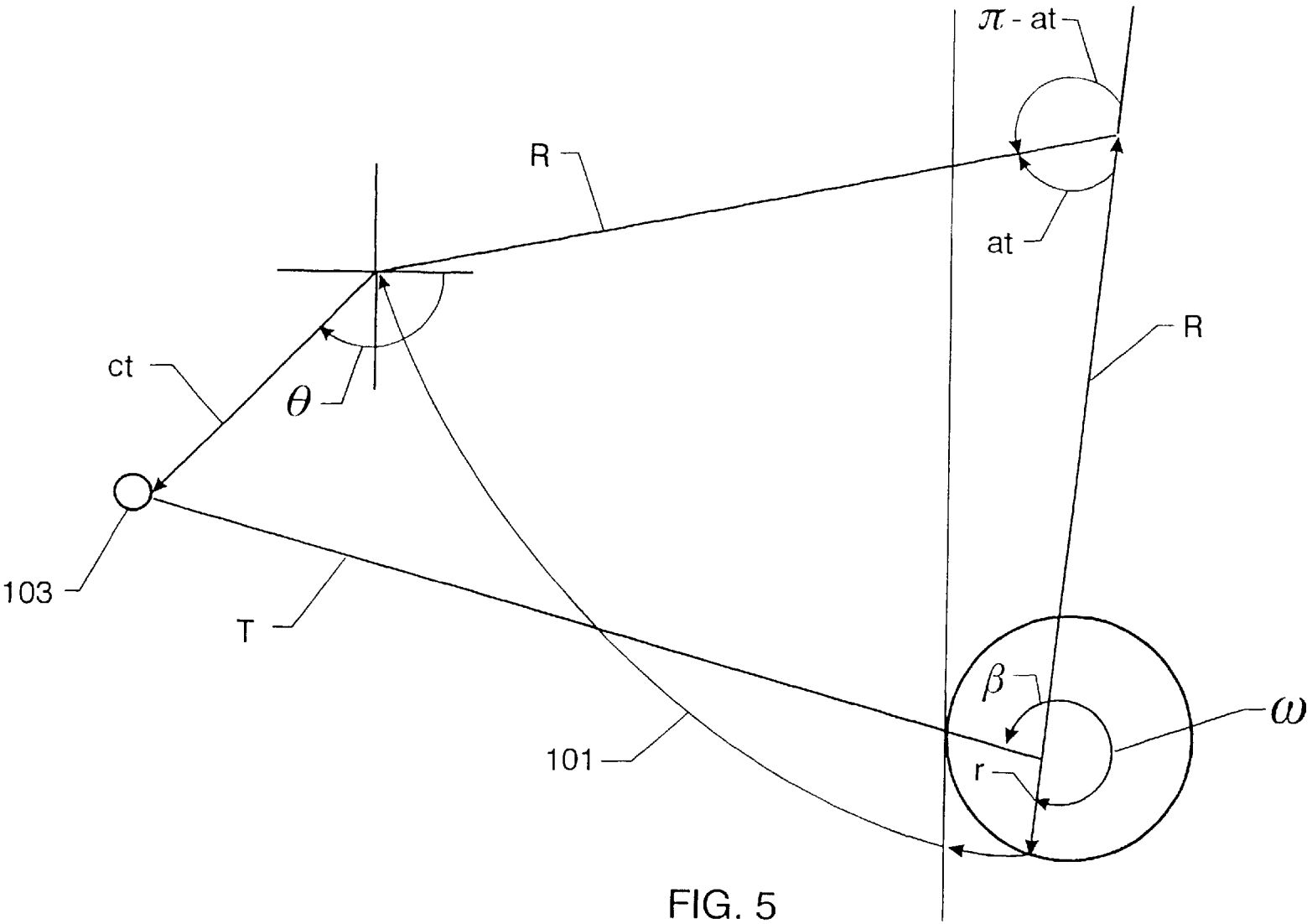
FIG. 5 is a diagram of the Coriolis correction for a right turn in the southern hemisphere.
Figure 6:
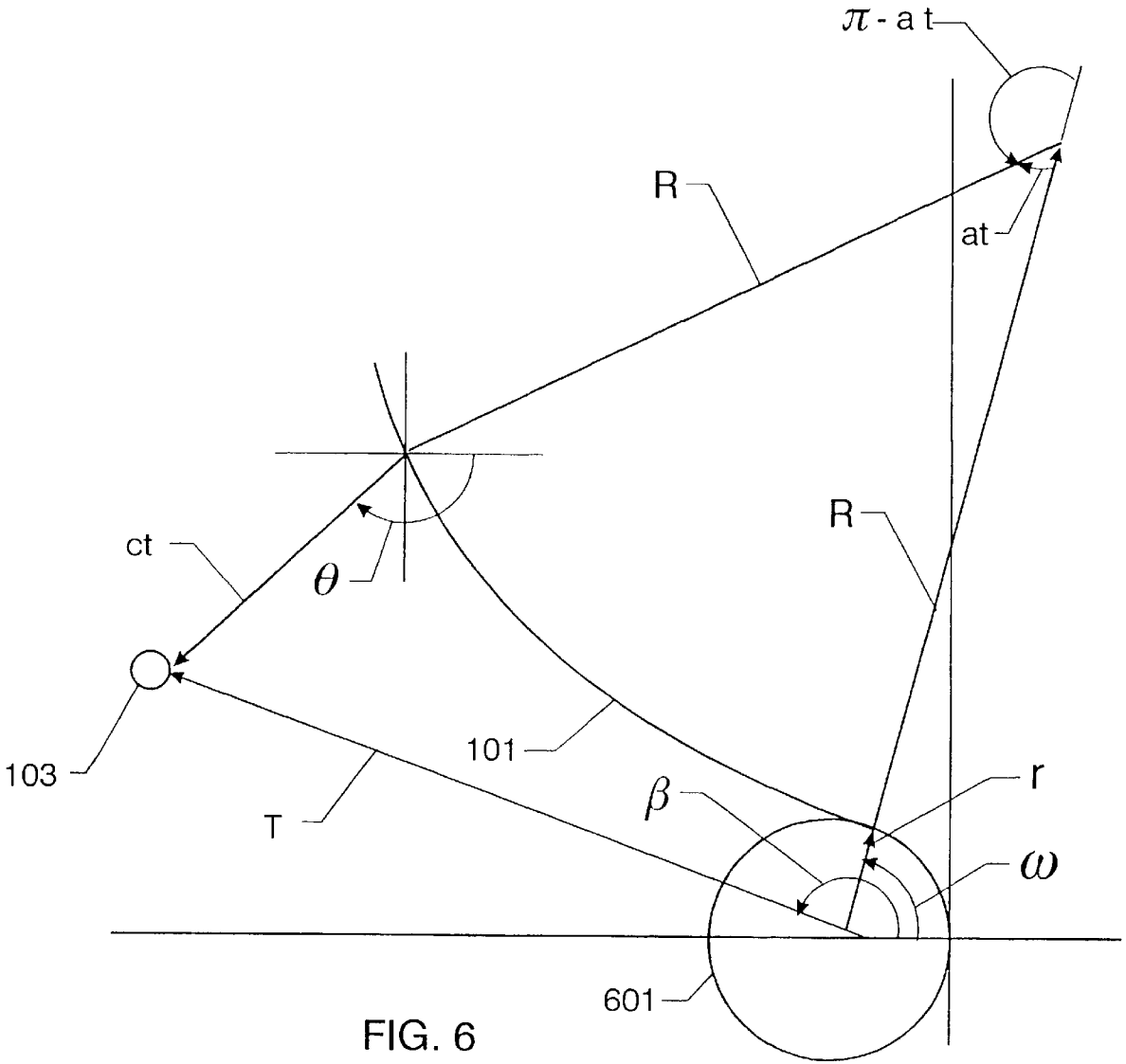
FIG. 6 is a diagram of the Coriolis correction for a left turn in the southern hemisphere.

The same equations are used for launching in the Southern Hemisphere but in the opposite sense. As shown in FIG. 5, the right turn requires the use of the configuration with the turning circle inside of the Coriolis circle. In this case, the inertial path 101 and aim point 103 are as shown. Similarly, in FIG. 6, a left turn to provide path 101 to aim point 103 uses the circles 601 externally tangent. FIG. 7 summarizes the use of this equations for right turns 701 and left turns 703 in the northern and southern hemispheres.

For calculations where the Coriolis factor (a), the current speed (c), and the weapon turn radius (r) are all finite, the equations presented will give good results. However, there are cases where these quantities may be zero. Table 1 lists the possible combinations of three quantities having either a finite value (x) or 0.

TABLE 1

| Case | a | c | r |
|---|---|---|---|
| 1 | x | x | x |
| 2 | x | x | 0 |
| 3 | x | 0 | x |
| 4 | x | 0 | 0 |
| 5 | 0 | x | x |
| 6 | 0 | x | 0 |
| 7 | 0 | 0 | x |
| 8 | 0 | 0 | 0 |

Case 1: For the first combination where (a), (c) and (r) are all finite, use equation 3 or equation 8 to find the run time, (t).

Case 2: For the second set equation 3 or equation 8 with r=0 will be used.

Case 3: With no current but turn radius finite, the solution of equation 3 is:

$$t = \frac{1}{\alpha}\cos^{-1}\left[\frac{R^2 + (R+r)^2 - r^2}{2(R+r)R}\right] \tag{10}$$

Case 4: With c=0 and r=0 equation 10 becomes:

$$t = \frac{1}{\alpha}\cos^{-1}\left[1 - \frac{T^2}{2R^2}\right] \tag{11}$$

The second set of four conditions in Table 1 requires a different approach to solving equation 3. As (a) approaches 0 in equation 3, the value of (R) approaches infinity. To avoid this difficulty let $$\cos(at) = 1 - 2\sin^2\left(\frac{at}{2}\right)$$

When (at)<0.2 radians $$\cos(at) \sim 1 - \frac{a^2t^2}{2}$$

and equation 3 becomes $$(c^2-(R+r)Ra^2)t^2-(2Tc\cos(\beta-\theta))t+T^2-r^2=0$$

Substitute R=s/a where s is the speed of the weapon $$(c^2-ras-s^2)t^2-(2Tc\cos(\beta-\theta)t+T^2-r^2=0 \tag{12}$$

Equation 12 defines the run time for case 5 through 8 in Table 1. In these cases, (a), has gone to a very small value or zero at the equator.

Case 5: With a=0 and (c) and (r) finite solve equation 12 for a positive value of (t). Within this case is a special sub-case where c=s. In equation 12 the coefficient of $t^2$ becomes zero and:

$$t = \frac{T^2 - r^2}{2Tc\cos(\beta-\theta)} \tag{12 A}$$

Case 6: With a=0, c finite and r=0 equation 12 becomes:

$$(c^2+s^2)t^2-[2Tc\cos(\beta-\theta)]t+T^2=0 \tag{13}$$

Within this case there is also a special case for c=s.

$$t = \frac{T}{2c\cos(\beta-\theta)} \tag{13 A}$$

Case 7: With a=0, c=0 and (r) finite the time is found from:

$$t = \frac{\sqrt{T^2 - r^2}}{s} \tag{14}$$

Case 8: With (a), (c) and (r) all equal to zero which represents a straight shot without either Coriolis effect or current and no turn radius.

$$t=T/s \tag{15}$$

Each of the values of (t) calculated above has a corresponding value of (ω). As long as (a) remains finite (the first four cases of Table 1), the value of (ω) will be found using either equation 5 or equation 9 in equation 4. When (a) approaches 0 in the second set of four cases in table 1, both the numerator N and the denominator D of equation 4 go to zero. To resolve this indeterminate form, both N and D are divided by R and R=s/a is substituted so that (a) appears explicitly in the expressions. Applying Hospital's Rule $$\tan(\omega) = \lim_{a\to 0}\left[\frac{\frac{dN}{da}}{\frac{dD}{da}}\right] = \frac{\frac{TR}{s}\sin(\beta) + Tt\cos(\beta) - \frac{ctr}{s}\sin(\theta) - ct^2\cos(\theta)}{\frac{Tr}{s}\cos(\beta) - Tt\sin(\beta) - \frac{ctr}{s}\cos(\theta) + ct^2\sin(\theta)} \tag{16}$$

Case 5: When a=0 and (c) and (r) are finite equation 16 will give ω when (t) is obtained from equation 12 or equation 12a.

Case 6: When a=0, (c) is finite and r=0.

$$\tan(\omega) = \frac{T\cos(\beta) - ct\cos(\theta)}{-T\sin(\beta) + ct\sin(\theta)} \tag{17}$$

Case 7: When both (a) and (c) are zero and (r) is finite:

$$\tan(\omega) = \frac{\frac{r}{s}\sin(\beta) + t\cos(\beta)}{\frac{r}{s}\cos(\beta) - t\sin(\beta)} \tag{18}$$

With (t) obtained from equation 14.

Case 8: When (a), (c) and (r) are all zero.

$$\omega = \tan^{-1}\left[\frac{\cos(\beta)}{-\sin(\beta)}\right] = \frac{\pi}{2} - \tan^{-1}\left[\frac{-\sin(\beta)}{\cos(\beta)}\right] = \frac{\pi}{2} + \beta \tag{19}$$

Figure 8:
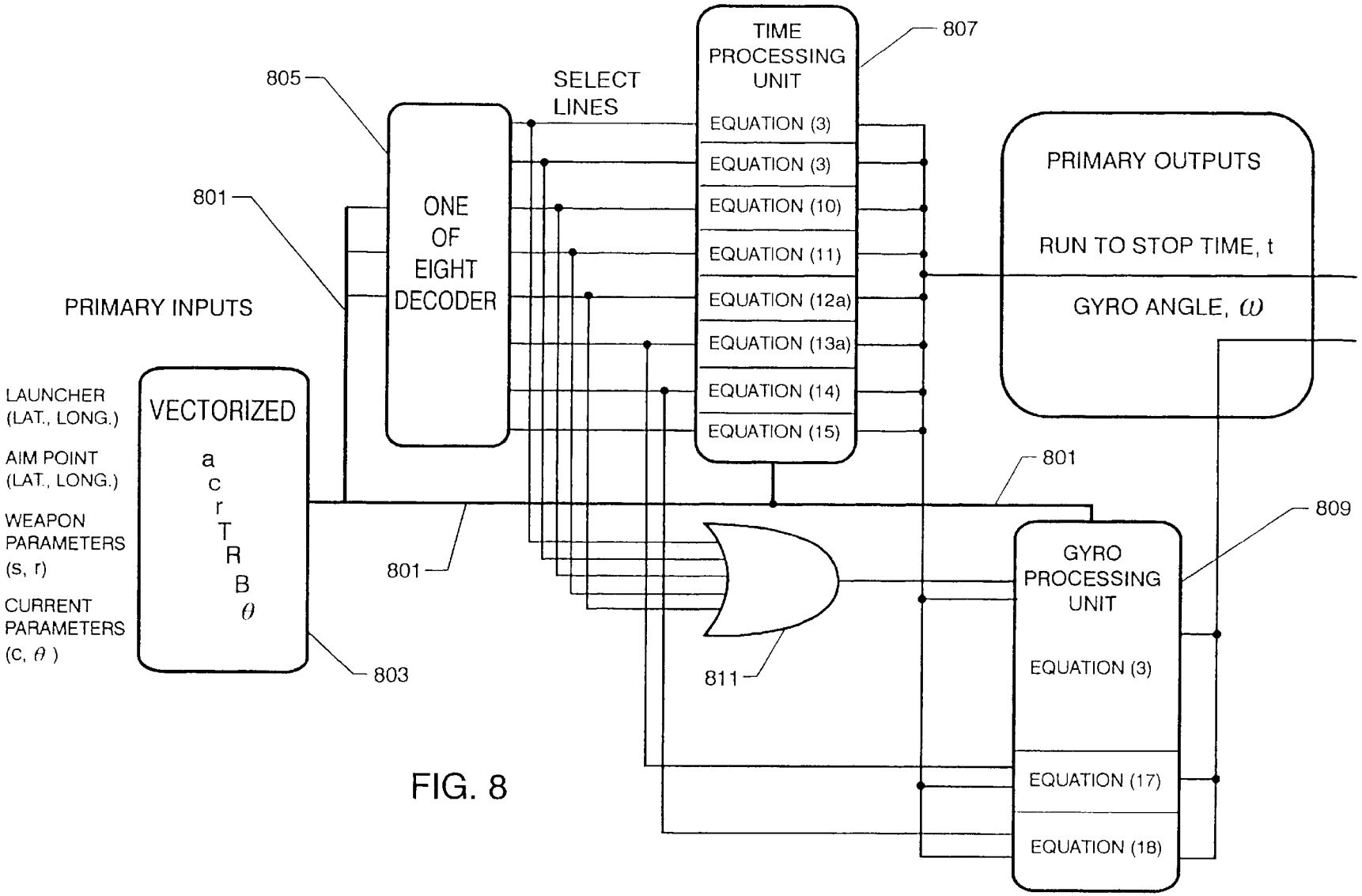
FIG. 8 is a diagram of the processing accomplished in the system.

Referring now to FIG. 8, the components units of the processor module 21 are depicted. The module comprises four sub-units tied together by a vector bus 801, a vectorizer 803, a one-of-eight decoder 805, a time-processing unit 807, and a gyro processing unit 809. The vectorizer 803 receives all external inputs and converts them into a vector format consisting of the Coriolis factor (a), water speed and direction (c, θ), weapon turn radius (r), and range and bearing to the aim point (T, β). This unit continuously recalculates the vector upon sensing any change to the inputs and provides the overall timing and control for all sections.

The one-of-eight decoder 805 computes the one's complement of Table 1 and enables or selects the appropriate sections of the time processing and the gyro processing units. This time processing unit 807 calculates the run to stop time required for the weapon and gyro calculations. It is comprised of eight sections that are associated with the Coriolis factor, water speed and weapon turn radius conditions of Table 1. Only one section is enabled or selected for the calculation. The gyroprocessing unit 809 calculates the gyro angle and is comprised of three sections that are associated with the Coriolis factor, the water speed, and the weapon turn radius conditions of Table 1. Only one section is enabled or selected for calculation. The OR gate 811 preceding the gyro processing unit 809 maps multiple Table 1 conditions into the first section.

The features and advantages of the underwater mine placement: system are numerous. The system models the Coriolis effect using a circular path which is corrected for latitude. It also models the turning circle of the weapon or underwater vehicle at launch. Data from the modeling process is automatically downloaded to the weapon and displayed to the launch officer. The steering and launch window displays allows weapon launch and accurate placement over a wide range of launch ship's position and maneuvers. Under conditions of hostile fire, these features eliminate the necessity of the launch ship having to follow a predictable course and speed. Finally, in the event conditions preclude the launch ship's meeting the launch window parameters, the actual placement of the weapon is recorded. It will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. An underwater mine placement system comprising:

an input module;

a processor module connected to said input module;

an external memory for storing launch parameters and weapons database information connected to said processor module;

a plurality of interface connectors connecting said processor module to a ship's inertial navigator;

an interface connector connecting said processor module to an underwater weapon for transferring steering and run time data; and a launch display connected to said processor module for displaying steering and launch information.

2. An underwater mine placement system as in claim 1 wherein said processor module includes a vector bus for connecting a plurality of sub-units.

3. An underwater mine placement system as in claim 2 wherein said processor module further comprises a vectorizer connected to said vector bus, and receiving all external inputs.

4. An underwater mine placement system as in claim 2 wherein said processor module further comprises a one-in-eight decoder connected to said vector bus.

5. An underwater mine placement system as in claim 2 wherein said processor module further comprises a time processing unit for calculating run to stop time for weapon and gyro calculations.

6. An underwater mine placement system as in claim 2 wherein said processor module further comprises a gyro processing unit for calculating gyro angle.

7. An underwater mine placement system as in claim 6 wherein said gyro processing unit further comprises three sections respectively associated with Coriolis factor, water speed, and weapon turn radius.

8. An underwater mine placement system as in claim 6 further comprising an OR gate connecting said gyro processing unit to said one-in-eight decoder.

9. An underwater mine placement system comprising:

means for inputting aiming and weapon type data;

means for processing the aiming and weapon type data connected to said input means;

means for receiving a ship's inertial data connected to said processing means; and a launch display connected to said means for processing.

10. An underwater mine placement system as in claim 9 wherein said means for inputting comprises an electronic module having latitude and longitude windows and controls for setting values in each window.

11. An underwater mine placement system as in claim 10 wherein said electronic module further includes a weapon selector for setting a type of underwater mine.

12. An underwater mine placement system as in claim 9 wherein said means for processing further comprises a processor having a vector bus for attachment of sub-units.

13. An underwater mine placement system as in claim 12 wherein said processor further comprises a vectorizer for receiving external inputs and converting those inputs to a vector format, said vectorizer attached to said vector bus.

14. An underwater mine placement system as in claim 12 wherein said processor further comprises a one-of-eight decoder for computing values for Coriolis factor, water current speed, and weapon turn radius, said one-of-eight decoder attached to said vector bus.

15. An underwater mine placement system as in claim 12 wherein said processor further comprises a time processing unit for calculating run-to-stop time of a weapon, said time processing unit attached to said vector bus.

16. An underwater mine placement system as in claim 12 wherein said processor further comprises a gyro processing unit for calculating gyro angle, said gyro angle processing unit attached to said vector bus.

17. A method for underwater mine placement comprising the steps of:

setting aim point parameters;

setting weapon type and parameters;

displaying launch window parameters;

reading launch vehicle inertial navigation parameters;

translating input parameter to local reference frame;

selecting a time processor section based on priorly set parameters;

calculating weapon run time;

selecting a gyro setting based on Coriolis effect, water speed and weapon turn radius;

calculating a weapon gyro angle; and updating a weapon with necessary navigation data.

* * * * *